US010661966B2

(12) United States Patent
Moore et al.

(10) Patent No.: US 10,661,966 B2
(45) Date of Patent: May 26, 2020

(54) CONTAINER WITH OXYGEN AND MOISTURE BARRIER AND SCAVENGER CAPABILITY

(71) Applicant: Link Snacks, Inc., Minong, WI (US)

(72) Inventors: Roger Moore, Minong, WI (US); Kent L. Oakland, Spooner, WI (US)

(73) Assignee: Link Snacks, Inc., Minong, WI (US)

( * ) Notice: Subject to any disclaimer, the term of this patent is extended or adjusted under 35 U.S.C. 154(b) by 438 days.

(21) Appl. No.: 14/924,019

(22) Filed: Oct. 27, 2015

(65) Prior Publication Data

US 2016/0122117 A1 May 5, 2016

Related U.S. Application Data

(60) Provisional application No. 62/072,179, filed on Oct. 29, 2014.

(51) Int. Cl.

| | |
|---|---|
| ***B65D 81/26*** | (2006.01) |
| ***B65D 51/30*** | (2006.01) |
| ***A24F 23/00*** | (2006.01) |
| ***B65D 51/20*** | (2006.01) |
| ***B65D 55/08*** | (2006.01) |

(Continued)

(52) U.S. Cl.

CPC ..... *B65D 81/264* (2013.01); *A24F 23/00* (2013.01); *B65D 51/20* (2013.01); *B65D 51/30* (2013.01); *B65D 55/0818* (2013.01); *B65D 81/266* (2013.01); *B65D 81/268* (2013.01); *B65B 3/00* (2013.01); *B65B 25/001* (2013.01); *B65B 29/00* (2013.01); *B65D 81/2069* (2013.01)

(58) Field of Classification Search

CPC ..... B65D 81/264; B65D 81/266; B65D 81/2069; B65D 81/268; B65D 51/30; B65D 55/0818; B65D 51/20; A24F 23/00

USPC ..... 206/204

See application file for complete search history.

(56) References Cited

U.S. PATENT DOCUMENTS 3,367,552 A * 2/1968 Krzyanowski ..... B65D 83/02 206/250

6,139,935 A * 10/2000 Cullen ..... B32B 5/16 206/204

(Continued)

OTHER PUBLICATIONS

International Search Report and Written Opinion (PCT/US2015/057580), dated Jan. 21, 2016.

*Primary Examiner* — Steven A. Reynolds

(74) *Attorney, Agent, or Firm* — Merchant & Gould P.C.

(57) ABSTRACT

A storage system for storing a product sensitive to oxygen or moisture includes a container with a bottom, a top edge defining a top opening, and a wall extending between the bottom and the top edge. The bottom, top edge, and wall define an inside volume. The system further includes a sealing member removably attached to the top edge and sealing the top opening, and a scavenger element in fluid communication with the inside volume, where the scavenger element is constructed to absorb moisture, oxygen, or a combination thereof. The wall and the bottom of the container include layers with at least one of an in-mold label, an oxygen barrier, or a moisture barrier. The system may further include a scavenger compartment and a retainer disc for retaining the scavenging element in the scavenger compartment. The container may optionally be flushed with an inert gas and hermetically sealed, and be closed with a lid.

19 Claims, 13 Drawing Sheets

(51) Int. Cl.

| | |
|---|---|
| *B65B 25/00* | (2006.01) |
| *B65D 81/20* | (2006.01) |
| *B65B 29/00* | (2006.01) |
| *B65B 3/00* | (2006.01) |

(56) References Cited

U.S. PATENT DOCUMENTS 6,279,744 B1 * 8/2001 Yu ..... B25H 3/022 206/372
6,913,808 B2 * 7/2005 Phillips ..... B32B 27/06 206/484
9,445,631 B1 * 9/2016 Patel ..... A24F 23/00
2003/0170357 A1 * 9/2003 Garwood ..... A23B 4/16 426/392
2004/0159658 A1 * 8/2004 McLaughlin ..... B65B 27/125 220/4.21
2005/0145593 A1 * 7/2005 Simone ..... B65D 41/0485 215/295
2006/0255001 A1 11/2006 Dempsey et al.
2008/0166395 A1 * 7/2008 Roush ..... A61K 9/0056 424/439
2009/0098323 A1 * 4/2009 Ohta ..... A23L 3/3436 428/35.7
2009/0246253 A1 * 10/2009 Ding ..... A61L 31/10 424/426
2011/0049003 A1 * 3/2011 Bellamah ..... B32B 15/08 206/531
2011/0186579 A1 * 8/2011 Bailey ..... B65D 25/54 220/495.01
2011/0244085 A1 10/2011 Crump et al.
2012/0015081 A1 * 1/2012 Crump ..... B65D 81/268 426/124
2012/0061263 A1 * 3/2012 Sibley ..... B65B 61/20 206/213.1
2012/0282690 A1 * 11/2012 Oura ..... C12M 29/26 435/366
2013/0233742 A1 * 9/2013 Bried ..... A24F 23/00 206/265
2013/0292279 A1 * 11/2013 Bengtsson ..... B65D 81/24 206/245
2014/0308404 A1 10/2014 Crawford
2015/0136618 A1 * 5/2015 Patel ..... A24F 23/00 206/0.5
2016/0106149 A1 * 4/2016 Potter ..... B65D 81/26 206/265
2016/0106150 A1 * 4/2016 Garcia ..... A24F 23/00 206/265
2016/0150819 A1 * 6/2016 McCormick ..... A24F 23/02 206/258

* cited by examiner

CONTAINER WITH OXYGEN AND MOISTURE BARRIER AND SCAVENGER CAPABILITY

CROSS-REFERENCE TO RELATED APPLICATIONS

This application claims the benefit of U.S. Provisional Application Ser. No. 62/072,179 filed Oct. 29, 2014, which is incorporated by reference herein in its entirety.

FIELD

The present disclosure relates to containers having oxygen and moisture barrier and scavenger capability. The present disclosure also relates to methods for increasing the shelf life of products that are susceptible to deterioration because of contact with moisture and/or oxygen.

BACKGROUND

Many products, such as foods, pharmaceuticals, nutritional supplements, cosmetics, and tobacco products, are sensitive to moisture and oxygen and hence have a finite shelf life. Exposure to moisture and/or oxygen can further shorten the shelf life of such products. Plastic, paper, paper board, and cardboard containers typically used for storing products have limited barrier capability and do not always adequately protect the product from moisture and/or oxygen to maximize shelf life. Even when the presence of oxygen and/or moisture is minimized during packaging, the conventional container materials allow oxygen and/or moisture to penetrate the walls of the container. Glass and metal containers, while providing superior barrier capability, have their limitations as to, for example, cost, weight, labeling, and convenience. Further, regardless of the material of the container, oxygen and moisture trapped inside the container with the product can act to shorten the product's shelf life.

It would therefore be beneficial to provide for a container with improved barrier and scavenger capabilities for oxygen and/or moisture.

SUMMARY

The present disclosure relates to a storage system for storing a product sensitive to oxygen or moisture includes a container with a bottom, a top edge defining a top opening, and a wall extending between the bottom and the top edge. The bottom, top edge, and wall define an inside volume. The system further includes a sealing member removably attached to the top edge and sealing the top opening, and a scavenger element in fluid communication with the inside volume, where the scavenger element constructed to absorb moisture, oxygen, or a combination thereof. The wall and the bottom of the container include layers with at least one of an in-mold label, an oxygen barrier, or a moisture barrier. The system may further include a scavenger compartment and a retainer disc for retaining the scavenging element in the scavenger compartment. The container may optionally be flushed with an inert gas and hermetically sealed, and be closed with a lid.

The present disclosure further provides a method for assembling a storage system comprising a container with a scavenger element and a sealing member. The method comprises placing the scavenger element in the container; placing the product in the container; and sealing the container. The container may optionally be flushed with an inert gas and hermetically sealed.

DETAILED DESCRIPTION

The present disclosure relates to storage systems designed to improve the shelf life of products that are sensitive to exposure to oxygen and/or moisture. In particular, the present disclosure relates to containers having a scavenger and barrier system with an oxygen and moisture barrier and scavenger capability. The present disclosure also relates to methods for increasing the shelf life of foods, pharmaceuticals, nutritional supplements, cosmetics, and tobacco products. The containers of the present disclosure are particularly suitable for storing foods, dried foods, pharmaceuticals, nutritional and dietary supplements, cosmetics, and tobacco products. According to exemplary embodiments, dried foods may include dried meat products, such as jerky (e.g., jerky made from beef, pork, poultry, or other meats suitable for human consumption), dried fruit or vegetables, grains, confectionaries, baked goods, etc. According to exemplary embodiments, pharmaceuticals may include medicines in the form of tablets, capsules, powders, etc. According to exemplary embodiments, nutritional and dietary supplements may include tablets, capsules, or powders of vitamins, minerals, herbs, probiotics, extracts, proteins, amino acids, enzymes, hormonal supplements, etc. According to exemplary embodiments, cosmetics may include capsules, creams, lotions, serums, powders, waxes, etc. According to exemplary embodiments, tobacco products may include dipping tobacco, snuff, chewing tobacco (e.g., loose leaf, pellets, plugs, twists), cigarettes, cigars, loose tobacco, pipe tobacco, tobacco paste, etc.

Figure 1:
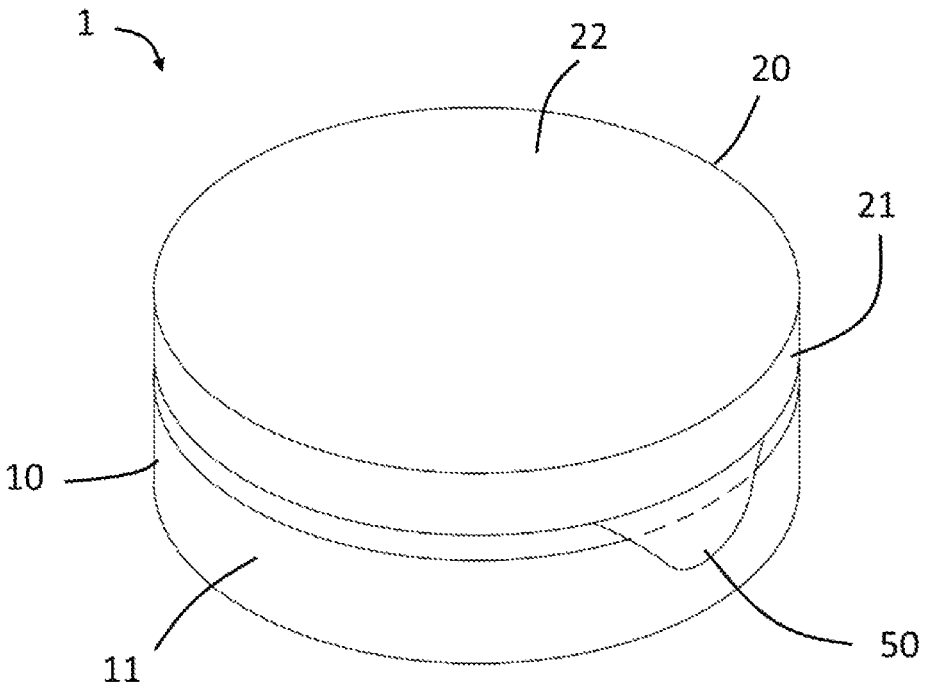
FIG. 1 shows a perspective view of a storage system according to an embodiment.
Figure 2:
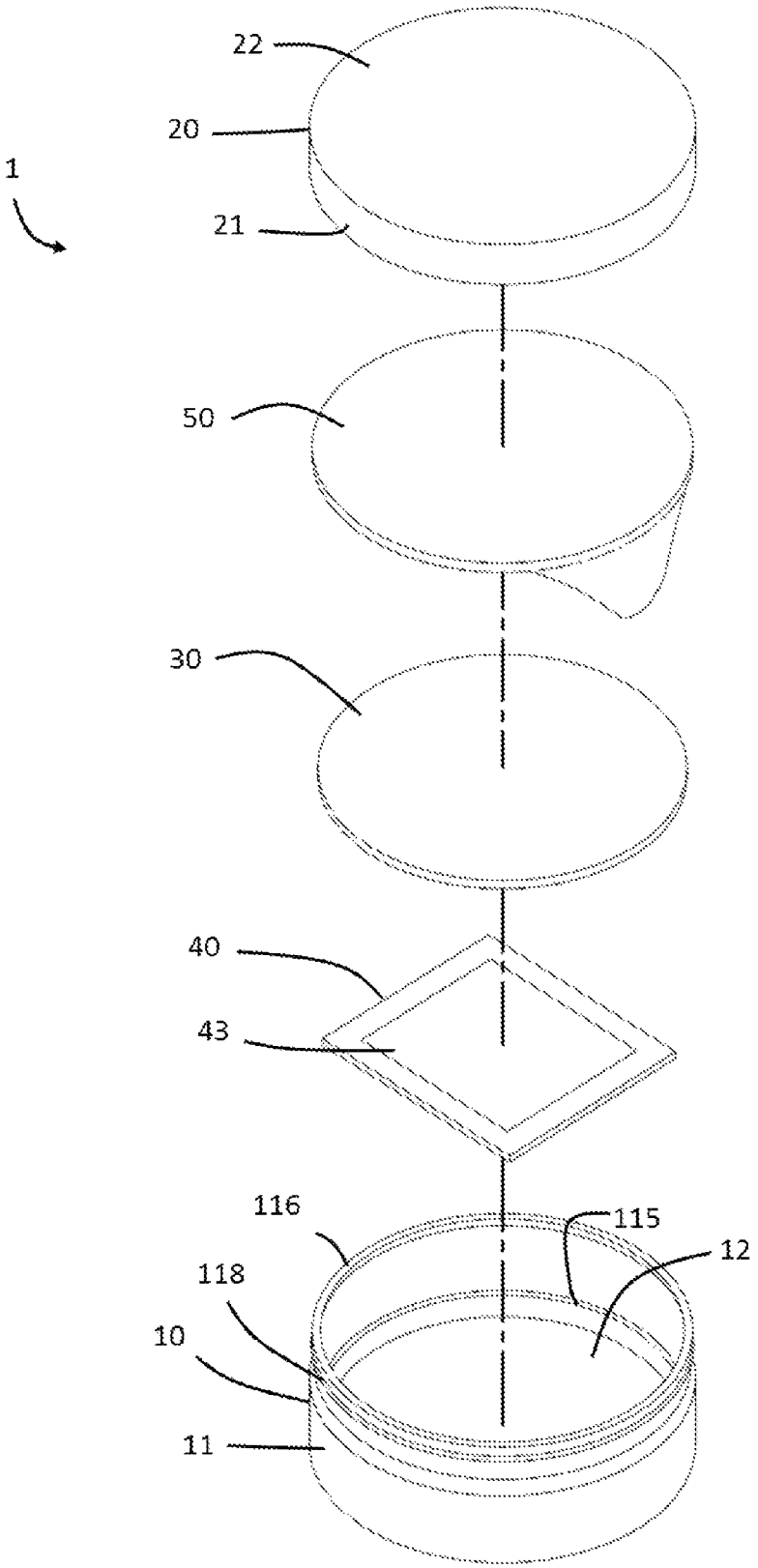
FIG. 2 shows an exploded view of the storage system of FIG. 1.

FIG. 1 shows an exemplary embodiment of the storage system 1 according to an embodiment. In an embodiment, the storage system 1 comprises a container 10 and a lid 20. FIG. 2 shows an exploded view of the storage system 1. In some embodiments, the storage system 1 further comprises a retainer disc 30, a scavenger element 40, and a sealing member 50. Alternatively, the scavenger element 40 may be positioned within the inside volume of the container without being retained by a retainer disc. According to an embodiment, the storage system 1 comprises elements that form a scavenger and barrier system 2 that absorbs oxygen and moisture trapped inside the container and minimizes further entry of oxygen and moisture into the container while the container is sealed with a sealing member 50 and/or closed with the lid 20. The scavenger and barrier system 2 comprises at least some of the following elements shown in the FIGURES: barrier layers 113, 123, 223; scavenger compartment 13; retainer disc 30; scavenger element 40; and sealing member 50 (see FIG. 6).

Figure 3A:
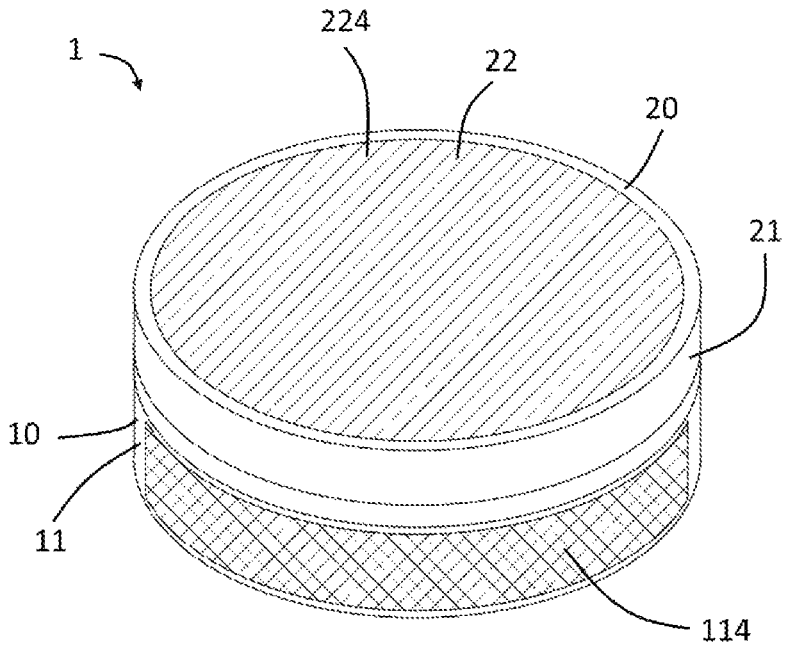
FIGS. 3A-3C show perspective views of the storage system according to embodiments.
Figure 3B:
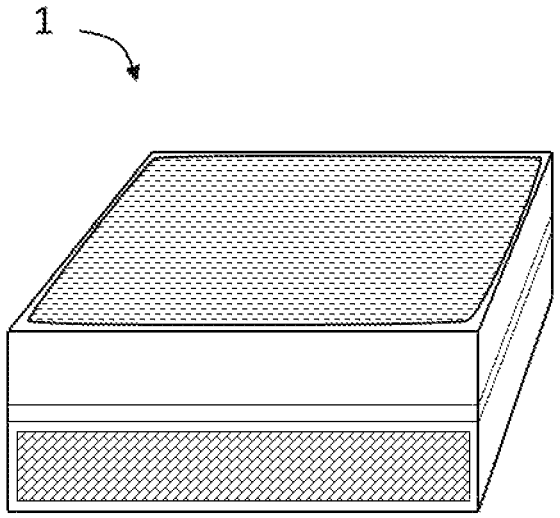
Figure 3C:
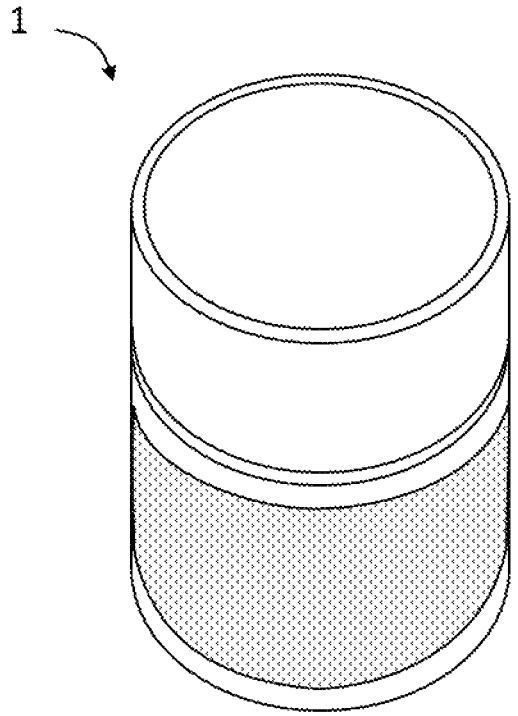

According to embodiments shown in FIGS. 3A-3C, the storage system 1 may have any suitable shape, such as the cylindrical or rectangular shape shown (optionally with rounded corners), an oval, or any other geometric, polygonal, regular or irregular shape, or the shape of a character (e.g., a cartoon, movie, or story book character). The container 10 and/or the lid 20 may comprise in-mold labeling. In-mold labeling can be manufactured during blow molding, injection molding, or thermoforming, where the in-mold label becomes an integral part of the final product. Various label types can be used, such as paper, polypropylene, or polystyrene labels that can optionally be cavitated or laminated. The in-mold label layer 114 may comprise any suitable label with text, coloring, logos, nutritional information, etc. In-mold labeling can be used with or without additional labels (e.g., paper or plastic labels).

FIGS. 4A-4D show various views of the container 10 according to an embodiment. The container 10 comprises a wall 11 and a bottom 12. The wall 11 comprises an inside surface 111 and an outside surface 112 defining a thickness T119 at a lower portion 119 of the wall 11 and a thickness T115 at an upper portion 115 of the wall 11, and a top edge 116 and bottom edge 117 defining a height H11. The wall 11 extends between the bottom edge 117 and the top edge 116. The thickness T115 of the upper portion 115 may be the same, or may be narrower than the thickness T119 at the lower portion 119 to accommodate the lid 20. For example, the thickness T115 of the upper portion 115 may be about 0.5-2.5 mm, or about 0.6-1.5 mm, and the thickness T119 at the lower portion 119 may be about 1-5 mm, or about 1.5-3 mm. However, the embodiments are not limited to specific geometric shapes and sizes, and various shapes and sizes of the container 10 are possible. The selected thicknesses T115 and T119 depend, in part, on the overall size of the container, with thicker wall thicknesses selected for larger containers. The wall 11 may also comprise a closure mechanism, such as a flange 118, threading, or other type of closure, that couples with a corresponding closure mechanism, such as a groove 213, threading, or other type of closure, on the lid 20. Any suitable closure mechanism can be used, such a tongue-and-groove, threading, a snap fit closure, and the like.

The bottom 12 has a diameter D12 and an inside surface 121 and outside surface 122 defining a thickness T12. The diameter D12 of the bottom 12 can be selected for any desired purpose and the embodiments are not limited by the particular geometric shape and size of the bottom. The diameter D12 may be, for example, about 20-200 mm, or about 40-100 mm. The bottom 12 may further comprise one or more extensions 125, such as a flange or a plurality of protrusions extending downward from the outside surface 122 of the bottom 12 to facilitate stacking of multiple containers 10.

The container 10 and lid 20 can be manufactured from any suitable material, such as food-grade polymers, cellulose-based materials, metals, glass, or a combination thereof. In a preferred embodiment, the container 10 is constructed from molded plastic, e.g., molded food-grade polymer. According to an exemplary embodiment, the polymer may comprise polypropylene, polyethylene, PET, polystyrene, etc. According to an exemplary embodiment, the cellulose based material may comprise paper, paper board, cardboard, etc. According to an exemplary embodiment, the metal may comprise aluminum, steel (e.g., stainless steel), etc.

Figure 4A:
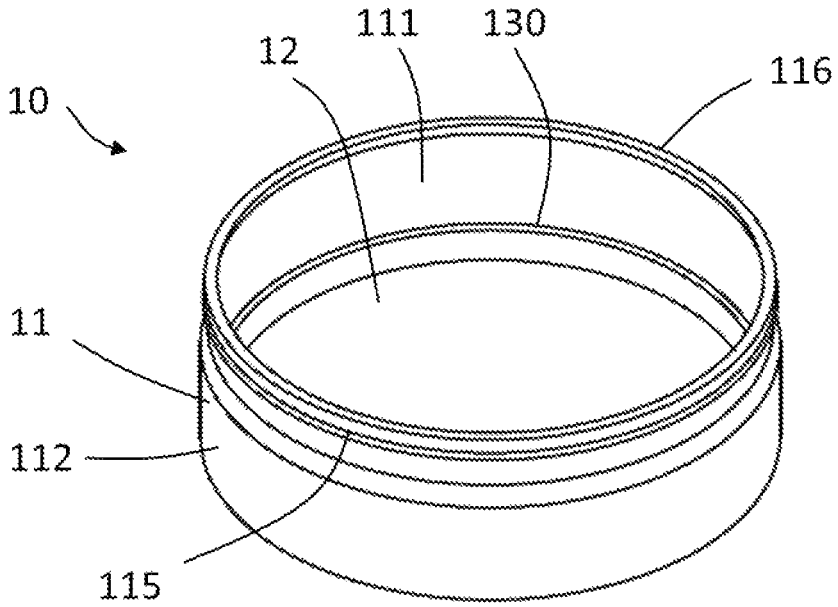
FIG. 4A shows a perspective view of a container of the storage system of FIG. 1.
Figure 4B:
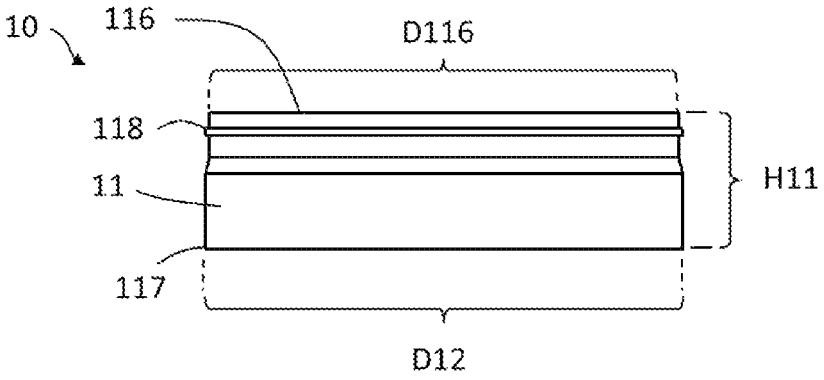
FIG. 4B shows a side view of the container of FIG. 4A.
Figure 4C:
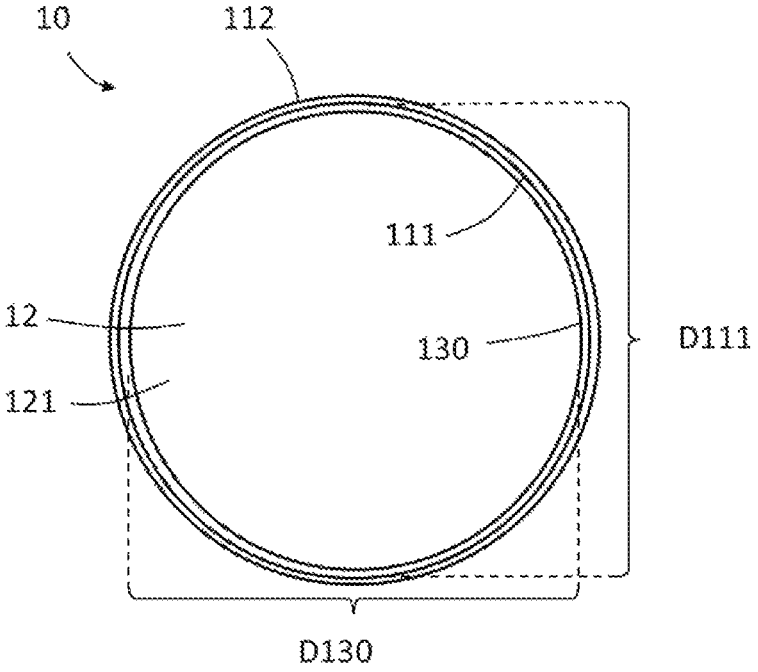
FIG. 4C shows a top view of the container of FIG. 4A.
Figure 4D:
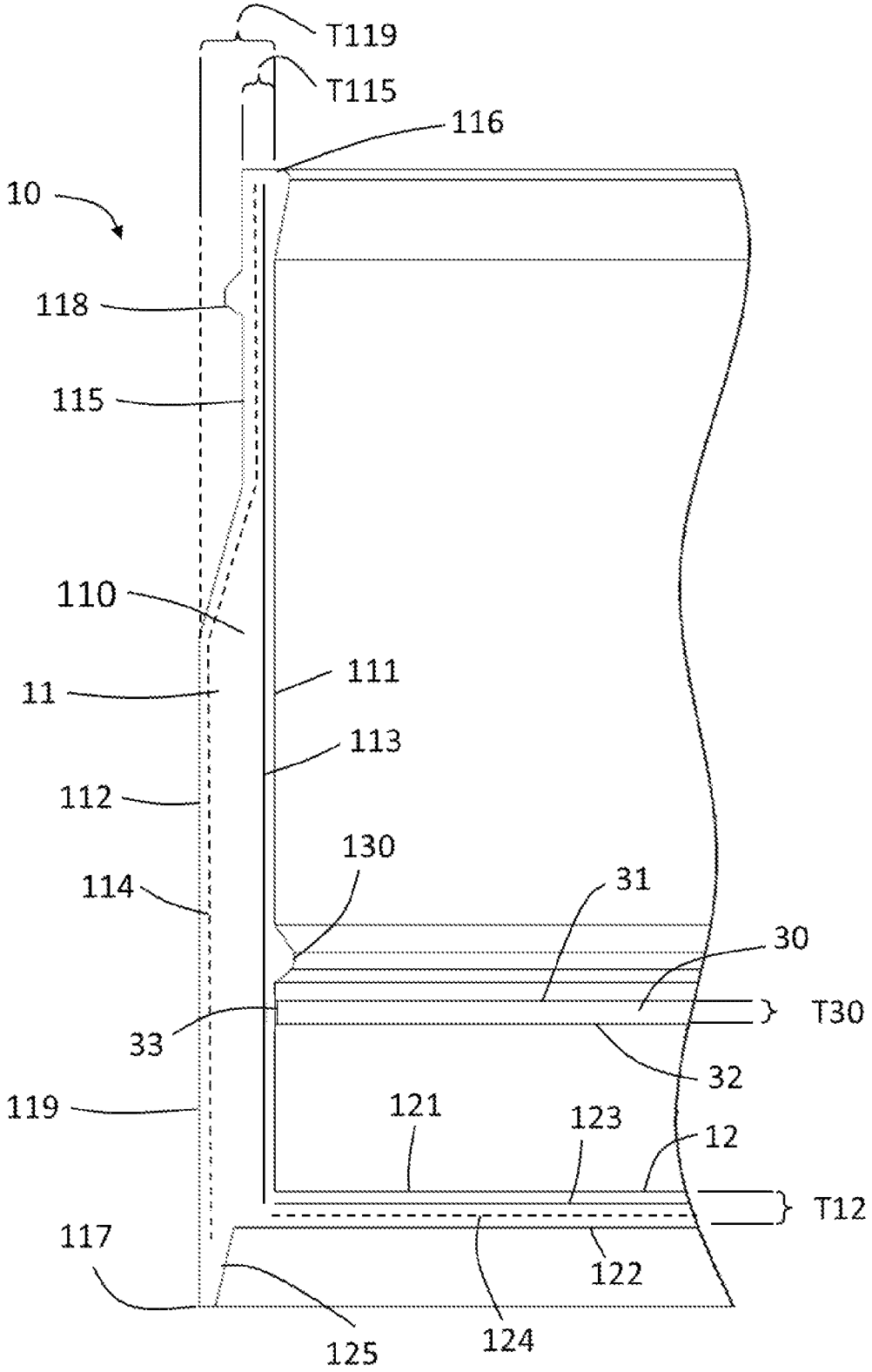
FIG. 4D shows a cross sectional view of a container of the storage system of FIG. 4A.
Figure 4E:
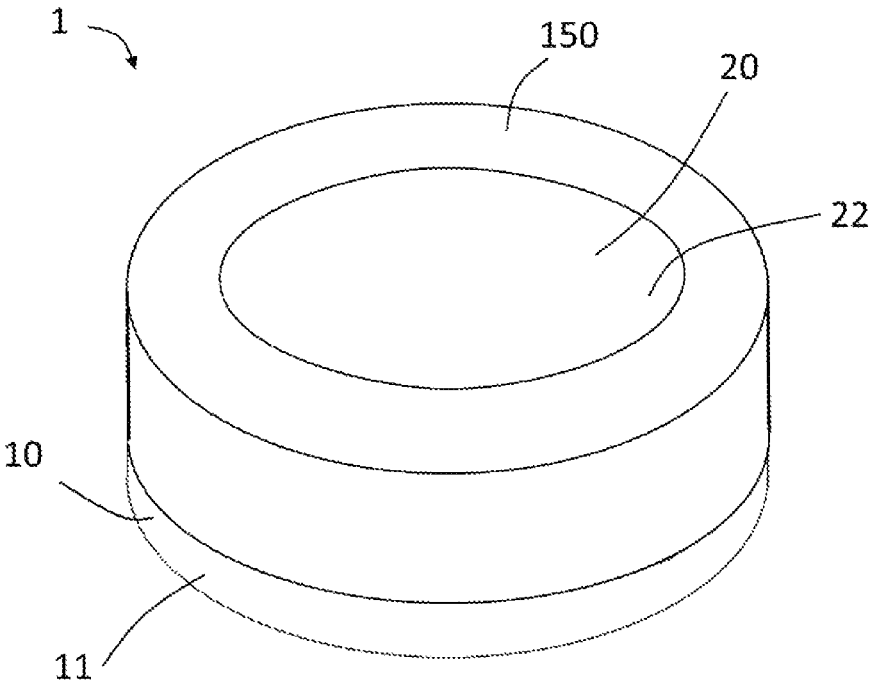
FIG. 4E shows a perspective view of a container of the storage system of FIG. 1.
Figure 5A:
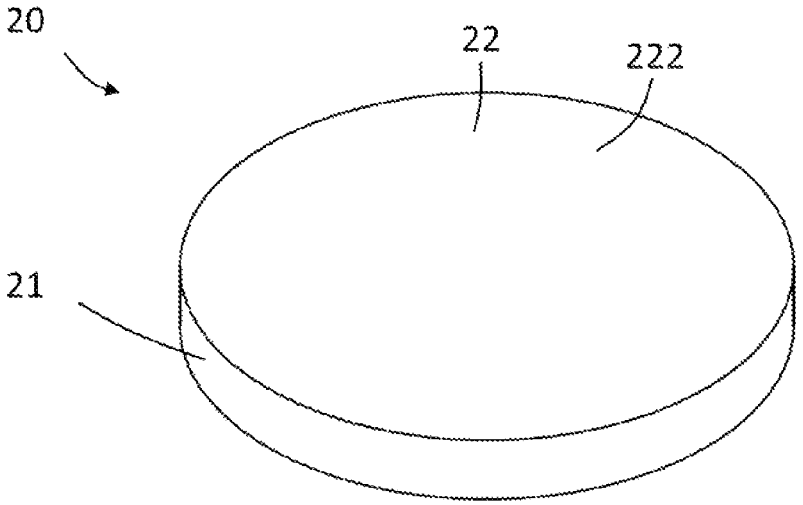
FIG. 5A shows a perspective view of a lid of the storage system of FIG. 1.
Figure 5B:
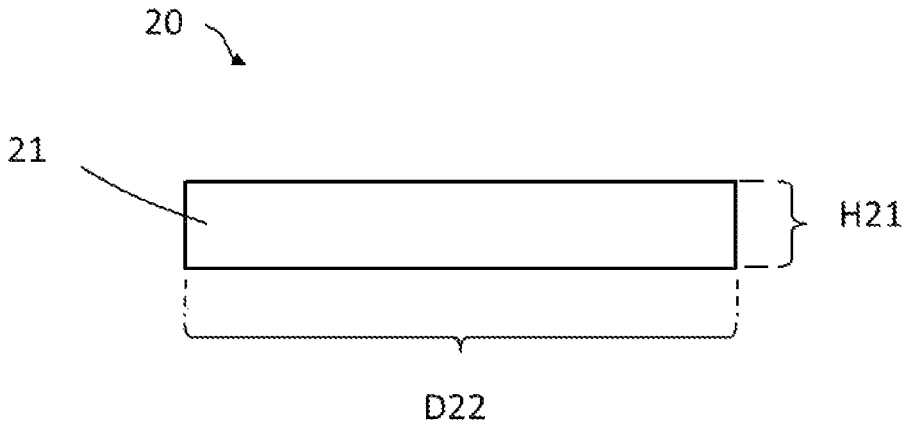
FIG. 5B shows a side view of the lid of FIG. 5A.
Figure 5C:
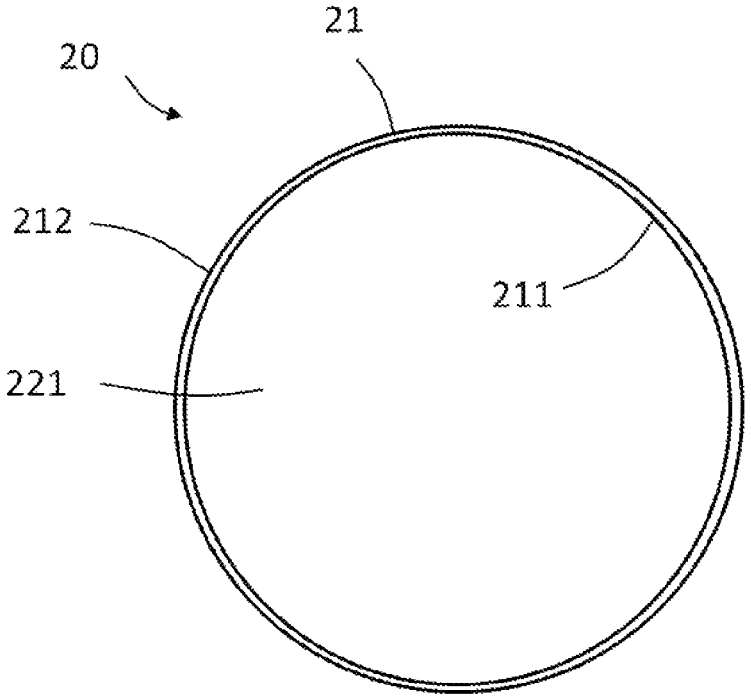
FIG. 5C shows a top view of the lid of FIG. 5A.
Figure 5D:
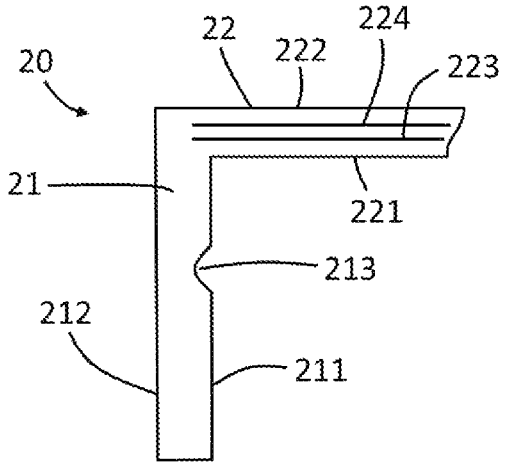
FIG. 5D shows a cross sectional view of the lid of FIG. 5A.

According to an embodiment shown in FIG. 4D, the wall 11 has a layered structure comprising a polymer layer 110, a barrier layer 113 and optionally an in-mold label layer 114. The barrier layer 113 may comprise an oxygen barrier and/or a moisture barrier. The barrier layer and in-mold label layer may also be provided in a single layer that has barrier capabilities. According to an embodiment, the bottom 12 may also have a layered structure comprising a barrier layer 123 and optionally an in-mold label layer 124. In an embodiment, the container 10 and lid 20 may be further enclosed in paper or polymer wrapping or sealed with a wrap-around seal such as a shrink sleeve or a paper sleeve, as shown in FIG. 4E.

FIGS. 5A-5D show various views of the lid 20 according to an embodiment. The lid 20 comprises a wall 21 connected to a top 22. The wall 21 comprises an inside surface 211 and an outside surface 212, and the top 22 comprises an inside surface 221 and an outside surface 222. The wall 21 may comprise a closure mechanism, such as a groove 213, threading, or other suitable closure, along the inside surface 211 of the wall 21 configured to couple with the corresponding closure mechanism, such as a flange 118, threading, or other suitable closure, on the container 10. The top 22 of the lid 20 may have a layered structure comprising one or more of a barrier layer 223 and an in-mold label layer 224. Alternatively the storage system 1 may be sealed with a seal on the outside of the lid. The seal may be a tamper-evident label or seal that can provide barrier properties. In an embodiment, the label or seal is a plastic seal or foil seal. In the embodiments, the diameter D20 of the lid approximately corresponds to the diameter D12 of the bottom 12 of the container 10.

In an embodiment, the barrier layers 113, 123, 223 are constructed to reduce permeability of the packaging to oxygen and/or moisture. For example, the barrier layers 113, 123, 223 may provide the container 10 and lid 20 with an oxygen transmission rate of about 20 $cm^3/m^2$/day or less, or about 15 $cm^3/m^2$/day or less, or about 10 $cm^3/m^2$/day or less, or about 5 $cm^3/m^2$/day or less, or about 3 $cm^3/m^2$/day or less, or about 1 $cm^3/m^2$/day or less, or about 0.5 $cm^3/m^2$/day or less as measured by the ASTM method F1927 at 50% relative humidity. The barrier layers 113, 123, 223 may provide the container 10 and lid 20 with a water vapor transmission rate of about 20 $g/m^2$/day or less, or about 15 $g/m^2$/day or less, or about 10 $g/m^2$/day or less, or about 5 $g/m^2$/day or less, or about 3 $g/m^2$/day or less, or about 1 $g/m^2$/day or less, or about 0.1 $g/m^2$/day or less as measured by the ASTM method F1249. In an embodiment, the barrier layers 113, 123, 223 have an oxygen transmission rate (OTR) of about 20 $cm^3/m^2$/day or less, or about 15 $cm^3/m^2$/day or less, or about 10 $cm^3/m^2$/day or less, or about 5 $cm^3/m^2$/day or less, or about 3 $cm^3/m^2$/day or less, or about 1 $cm^3/m^2$/day or less, or about 0.5 $cm^3/m^2$/day or less as measured by the ASTM method F1927 at 50% relative humidity. In an embodiment, the barrier layers 113, 123, 223 have a water vapor transmission rate of about 20 $g/m^2$/day or less, or about 15 $g/m^2$/day or less, or about 10 $g/m^2$/day or less, or about 5 $g/m^2$/day or less, or about 3 $g/m^2$/day or less, or about 1 $g/m^2$/day or less, or about 0.1 $g/m^2$/day or less as measured by the ASTM method F1249. In one embodiment, the barrier layers 113, 123, 223 are substantially non-permeable to both oxygen and moisture having an oxygen transmission rate of less than 1 $cm^3/m^2$/day or less and a water vapor transmission rate of less than 1 $g/m^2$/day or less. The barrier layers 113, 123, 223 may further be UV resistant.

The barrier layers 113, 123, 223 may comprise coextruded cast or blown films with moisture and/or oxygen barrier capability, such as those available from Winpak Films, Inc., in Senoia, Ga.; Sealed Air Corp. in Elmwood Park, N.J.; or Propyplast in Retournac, France. The barrier layer 113, 123, 223 may comprise any suitable material with barrier capability, such as polypropylene, oriented polypropylene, ethylene vinyl alcohol, nylon (i.e., polyamide), oriented polyamide, polyethylene, polyethylene terephthalate, or combinations thereof. According to an exemplary embodiment, the material comprises a coextruded film or a coextruded multilayer film.

Figure 6:
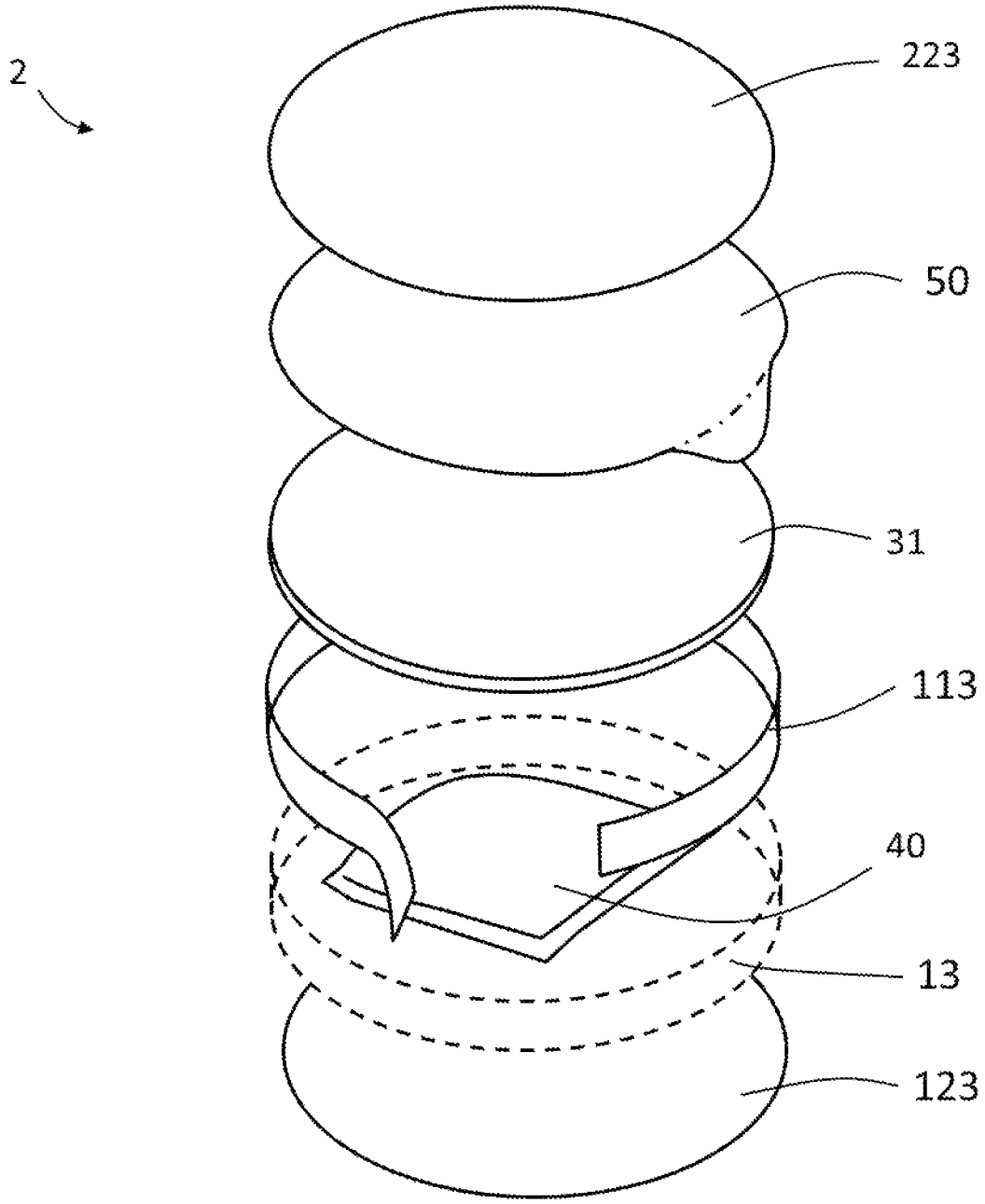
FIG. 6 shows an exploded view of a scavenger and barrier system of the storage system of FIG. 1.

FIG. 6 shows an exemplary embodiment of the scavenger and barrier system 2. According to an embodiment, the scavenger and barrier system 2 comprises a scavenger compartment 13 for housing a scavenger element 40. The scavenger compartment 13 is located inside the space defined by the container 10 and lid 20. For example, the scavenger compartment 13 may be located at the bottom of the container 10 as shown in the exemplary embodiment in the FIGURES, or in the lid 20. In an embodiment, the retainer disc 30, the bottom 12 and the lower part of the wall 11 of the container 10 define the scavenger compartment 13. The scavenger and barrier system 2 may further comprise barrier layers 113, 123, 223 and sealing member 50.

In an alternative embodiment, the storage system 1 is sealed on the outside with, for example, a tamper-evident seal, such as a shrink-wrap seal 150 that can be wrapped around the sides of the container 10 and lid 20 and optionally extend partially or fully onto the top 22 of the lid 20 and/or onto the bottom 12 of the container to provide a hermetic seal. An example of a shrink-wrap seal 150 is shown in FIG. 4E, where the seal wraps partially onto the top 22 of the lid 20 and extends part of the way down the wall 11 of the container 10. Using a seal on the outside of the storage system 1 may obviate the need for some of the elements of the scavenger and barrier system 2, such as barrier layer 113 or seal 50. In an embodiment, the shrink-wrap seal comprises an OTR of about 20 $cm^3/m^2$/day or less, or about 15 $cm^3/m^2$/day or less, or about 10 $cm^3/m^2$/day or less, or about 5 $cm^3/m^2$/day or less, or about 3 $cm^3/m^2$/day or less, or about 1 $cm^3/m^2$/day or less, or about 0.5 $cm^3/m^2$/day or less as measured by the ASTM method F1927 at 50% relative humidity. In an embodiment, the shrink-wrap seal comprises a water vapor transmission rate of about 20 $g/m^2$/day or less, or about 15 $g/m^2$/day or less, or about 10 $g/m^2$/day or less, or about 5 $g/m^2$/day or less, or about 3 $g/m^2$/day or less, or about 1 $g/m^2$/day or less, or about 0.1 $g/m^2$/day or less as measured by the ASTM method F1249. In one embodiment, the shrink-wrap seal is substantially non-permeable to both oxygen and moisture having an oxygen transmission rate of less than 1 $cm^3/m^2$/day or less and a water vapor transmission rate of less than 1 $g/m^2$/day or less. The shrink-wrap seal may further be UV resistant. In an embodiment, the shrink-wrap seal comprises a polyester, polypropylene, ethylenevinyl alcohol (EVOH), or a combination thereof.

FIG. 4D shows the container 10 having a holding element (e.g., a lip 130) for holding a retainer disc 30 in place according to an embodiment. The lip 130 extends radially inwardly from the inside surface 111 of the wall 11 so that the container has a diameter D130 at the lip 130 that is smaller than the inside diameter D111 of the container 10. For example, the lip 130 can extend about 0.3-2 mm, or about 0.5-1.5 mm inward from the inside surface 111 of the wall 11. Although a continuous lip around the inside surface 111 of the wall 11 is shown, other configurations are of course possible. For example, the holding element can be configured as a plurality of inward extensions that are circumferentially placed around the inside surface 111 of the wall 11.

Figure 7A:
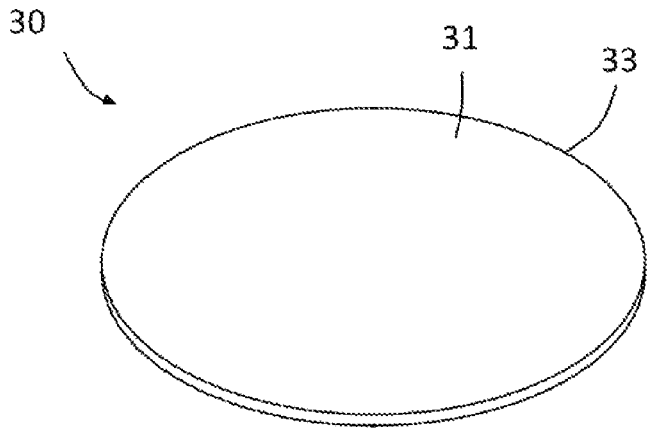
FIG. 7A shows a perspective view of a retainer disc of the storage system of FIG. 1.
Figure 7B:
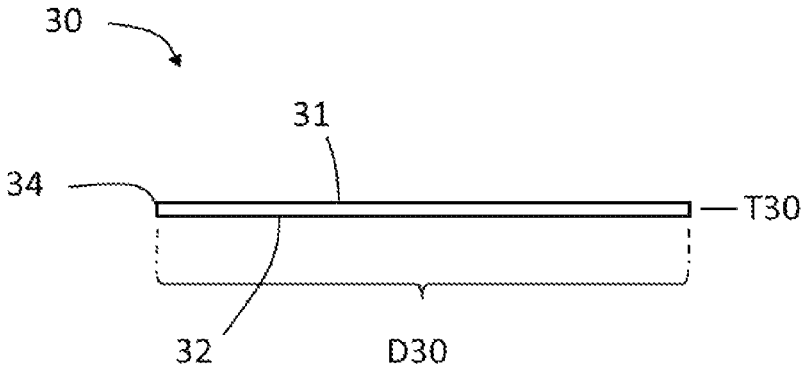
FIG. 7B shows a side view of the disc of FIG. 7A.
Figure 7C:
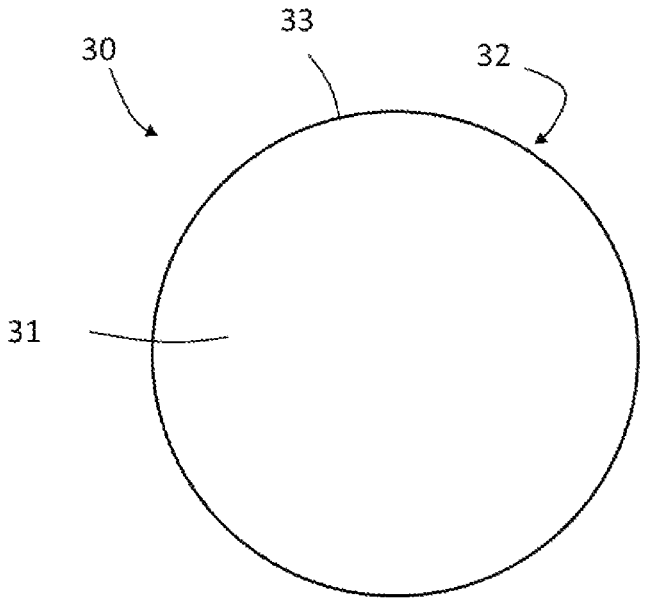
FIG. 7C shows a top view of the disc of FIG. 7A.

FIGS. 7A-7C show various views of the retainer disc 30 according to an embodiment. The retainer disc 30 has an edge 33 defining a diameter D30 and top surface 31 and bottom surface 32 defining a thickness T30. The diameter D30 is larger than diameter D130 such that when the edge 33 of the retainer disc 30 is pushed below the lip 130, the retainer disc 30 is held in place by the lip 130. In the embodiments, the retainer disc 30 comprises a material that is permeable to oxygen and moisture, such as a cellulose based material or a porous polymer membrane. The material of the retainer disc 30 can be selected to be compatible with the product stored in the storage system 1. For example, a product that is more coarse (e.g., comprises large granules with particle size greater than 1 mm, tablets, or capsules) and dry can be compatible with a more porous material having a pore size in the μm to mm scale, whereas a product that is more fine (e.g., is finely ground with a particle size less than 1 mm) or comprises a liquid (e.g., an oil or solvent) can be compatible with a material that has a small pore size, e.g., in the nm to μm scale.

In an alternative embodiment, the scavenger element 40 and the retainer disc 30 can be integrated into a single unit that is held in place inside the container 10 by the lip 130. In another alternative embodiment, the scavenger element 40 can be held in place by a seal or be located on the underside of the lid 20, for example held in place by a seal, by a retainer, or by an adhesive, or may be integrated into the material of the lid 20.

In the schematic drawings, the scavenger element 40 is shown as having a square shape. However, the scavenger element 40 is not limited to square or rectangular shapes and could, of course, be of any suitable shape or size including but not limited to round, triangular, or novelty shapes.

In an embodiment, the scavenger element 40 may comprise an oxygen scavenger, a moisture scavenger, or a combination thereof. For example, the scavenger element 40 may comprise a mixture of a first scavenger capable of absorbing oxygen and a second scavenger capable of absorbing moisture. According to an exemplary embodiment, the first scavenger comprises a mixture of elemental iron, iron powder, autoclaved clay, sodium chloride, calcium, ascorbic acid, and/or zeolite, or polymeric materials capable of absorbing oxygen. According to an exemplary embodiment, the second scavenger comprises oxazolidine, aluminosilicate or polymeric materials capable of absorbing moisture. The scavenger element 40 may further comprise other scavengers capable of absorbing oxygen, moisture, or other gases (e.g., organic molecules that may cause off-flavors). According to an exemplary embodiment, other scavengers include activated carbon. The scavenger materials of the scavenger element 40 may be housed in a scavenger container 43 that is permeable to at least moisture and oxygen. The scavenger container 43 can comprise, for example, a permeable pouch, packet, bag, or a perforated polymer container. Alternatively the scavenger element 40 may be placed in the storage system 1 without a scavenger container 43. For example, the scavenger element 40 may comprise beads or granules that are housed in the scavenger compartment 13. In an alternative embodiment, the scavenger element 40 is comprised as a layer in the wall 11, bottom 12, lid 20, and/or retainer disc 30. The scavenger element 40 may comprise, for example, a layer of oxygen and/or moisture scavenging film, for example OS 1000 film available from Sealed Air Corp. of Elmwood Park, N.J.

The container 10 may be further sealed by a sealing member 50 sealed to the top edge 116 of the wall 11 of the container 10. The sealing member 50 may be comprised of any suitable material, such as metal foil, a polymer, paper, or a combination thereof (e.g., a metalized layer). For example, the sealing member 50 may comprise an aluminum foil layer and a polymer layer. According to an exemplary embodiment, the polymer comprises polyester, polypropylene, EVOH, or a combination thereof. In the embodiments, the sealing member 50 is non-permeable to oxygen and/or moisture.

Figure 8:
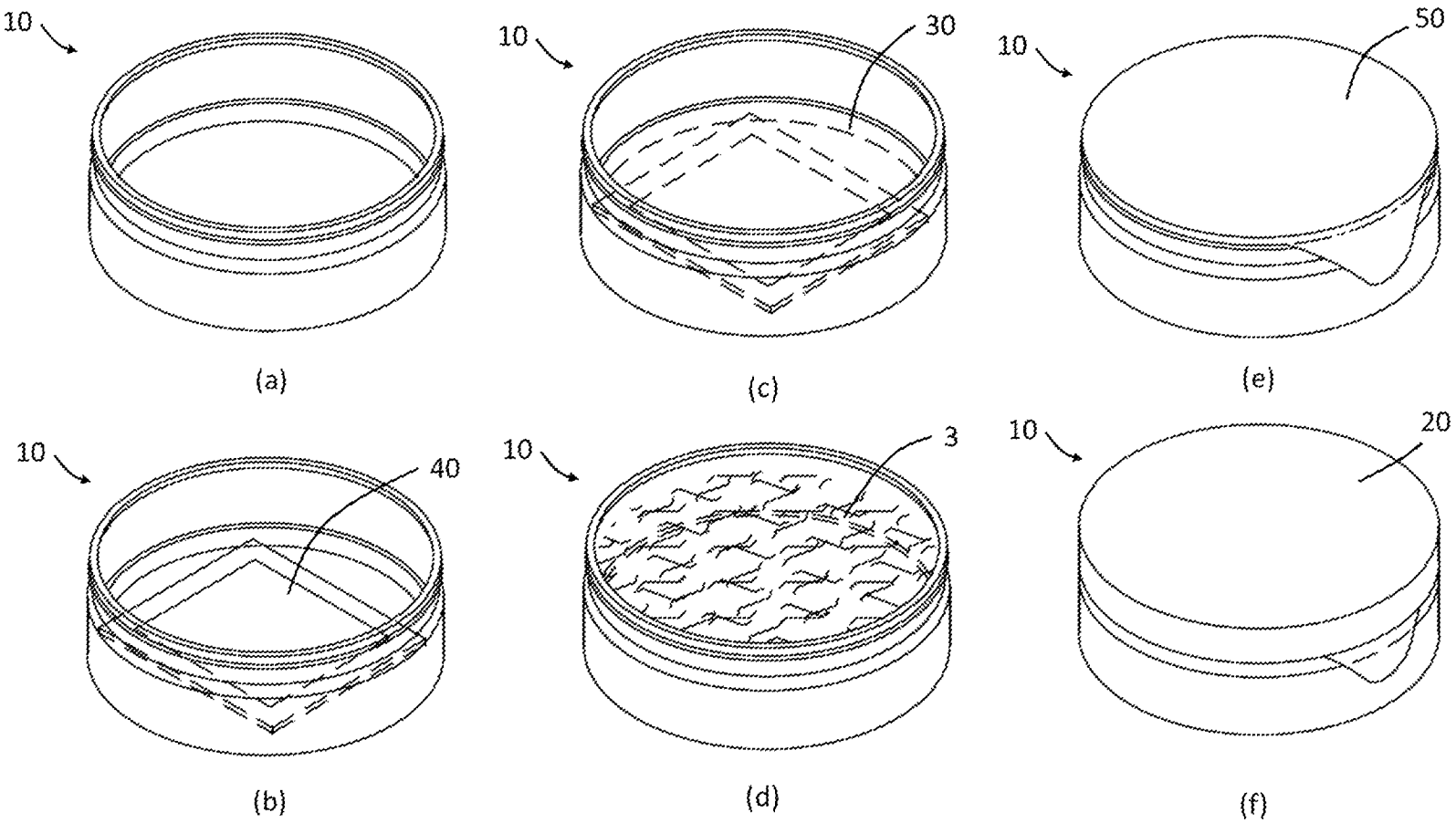
FIG. 8 shows a cartoon of the assembly of the storage system of FIG. 1.

FIG. 8 shows a cartoon depiction of assembling the storage system 1 according to an embodiment where the storage system 1 includes a retainer disc 30 and lid 130. First (a)-(b), the scavenger element 40 (in the exemplary embodiment shown a pouch containing scavenging materials) is placed onto the bottom of the empty container 10. The retainer disc 30 is next placed on top of the scavenger element 40 and snapped into place so that the edge 33 of the retainer disc 30 is positioned below and held in place by the lip 130 in step (c). The product is then placed into the container 10 on top of the retainer disc 30 in step (d). According to an exemplary embodiment, the product comprises a food product, medication, nutritional supplement, cosmetic product, or tobacco product. The container 10 is sealed with a sealing member 50 (e.g., a foil seal) in step (e) and closed with the lid 20 in step (f). The steps and order of assembling the storage system 1 will, of course, depend on the construction of the system.

According to alternative embodiments, the storage system 1 can be assembled without the retainer disc 30 and/or without the lid 130, being sealed by the sealing member 50. If the storage system 1 is sealed by the sealing member 50 only and does not include a lid 130, the sealing member 50 may be constructed of layered foil, e.g., comprising metal foil and polymer layers.

After the storage system 1 has been closed and sealed, any remaining moisture and oxygen in the container 10 is absorbed by the scavenging materials of the scavenger element 40. The barrier properties of the barrier layers 113, 123, 223 minimize or prevent the entry of oxygen and moisture from the surrounding atmosphere. The container 10 may optionally be purged with an inert gas, such as nitrogen, during packaging and before sealing. A nitrogen purge may be done, for example, by using a controlled atmosphere, by over-gassing (i.e., purging), or by using liquid nitrogen. If inert gas is used to replace atmospheric air in the container, the scavenging element may be omitted from the container.

According to an embodiment, the storage system 1 can improve the shelf life of a product, such as a food product, medication, nutritional supplement, cosmetic product, or tobacco product. For example, the storage system 1 can improve shelf life of a product by at least 14 days, or at least 28 days, or at least 40 days, or at least 60 days, or at least 75 days, or at least 90 days, or at least 120 days, or at least one year, as compared to a similar item stored in a conventional container (e.g., paper, paper board, or plastic) without enhanced scavenger or barrier properties. The stability or shelf life of the product can be evaluated, for example, by monitoring the color of the product. Color monitoring can be done using any suitable equipment, such as a colorimeter (commercially available from, for example, Hunter Associates Laboratory, Inc. in Reston, Va., or from Alpha MOS in Hanover, Md.), or visually. Color monitoring of the product can include monitoring the overall color or a particular color component, such as the red, green, red-green, yellow, blue, yellow-blue, white, black, or white-black component. In some embodiments, storing the product in the storage system 1 retards changes in the color or the product. For example, storing the product in the storage system 1 may retard loss of the color component red, or overall lightening of the product.

EXAMPLES

Dried meat products known as jerky can be provided in a shredded form. The jerky is generally made from beef, chicken, turkey, or pork. Shredded jerky is often sold in containers made from plastic (e.g., polypropylene or polyethylene), paperboard, metal, or their combinations, similar to those used to store some tobacco products. The containers are typically sealed with a tamper-evident paper seal surrounding a round container and the edge of the lid. However, the existing containers present a problem in that oxygen and moisture present in the container shorten the shelf life of the food product.

Samples of a dried meat product were stored under controlled conditions in various containers to test for shelf life of the product. The testing was done at 35° C. and 50% relative humidity.

Example 1

Samples of dried meat were divided into three groups, each group being stored under different conditions.

Sample group 1 was stored in a conventional polypropylene container with a polypropylene lid and a tamper-evident paper seal on the outside of the container.

Sample group 2 was stored in a container according to an embodiment of the present disclosure having a barrier layer around the sides and bottom of the container, a foil seal, and an oxygen scavenger with 20 $cm^3$ capacity.

Sample group 3 was stored in a container according to an embodiment of the present disclosure having a barrier layer around the sides and bottom of the container, a foil seal, and an oxygen scavenger with 50 $cm^3$ capacity.

One sample from each group was opened and evaluated at 0, 2, 7, 14, 27, and 77 days. Results are shown in TABLE 1 below. Color change of the samples was denoted with +-signs on a scale of 0-4 with 0 indicating no change, and 4 indicating a significant change in color.

Sample group 1 showed slight changes (some signs of oxidation) in quality at 7 days, and clear changes (clear signs of oxidation) at 14 days. Samples from groups 2 and 3 did not show changes in quality (signs of oxidation) throughout the testing period.

TABLE 1

| | Group 1 (no scavenger, conventional container) | Group 2 (20 $cm^3$ $O_2$ scavenger, barrier container) | Group 3 (50 $cm^3$ $O_2$ scavenger, barrier container) |
|---|---|---|---|
| Day 0 | 0 | 0 | 0 |
| Day 2 | 0 | 0 | 0 |
| Day 7 | + | 0 | 0 |
| Day 14 | ++ | 0 | 0 |
| Day 27 | ++ | 0 | 0 |
| Day 77 | ++++ | 0 | 0 |

Example 2

Samples of seasoned dried meat were divided into three groups, each group being stored under different conditions.

Sample group 1 was stored in a conventional polypropylene container with a polypropylene lid and a tamper-evident paper seal on the outside of the container.

Sample group 2 was stored in a container according to an embodiment of the present disclosure having a barrier layer around the sides and bottom of the container, a foil seal, and an oxygen scavenger with 20 $cm^3$ capacity.

Sample group 3 was stored in a container according to an embodiment of the present disclosure having a barrier layer around the sides and bottom of the container, a foil seal, and an oxygen scavenger with 50 $cm^3$ capacity.

One sample from each group was opened and evaluated at 0, 6, 14, 27, and 77 days. Results are shown in TABLE 2 below. Color change of the samples was denoted with +-signs on a scale of 0-4 with 0 indicating no change, and 4 indicating a significant change in color.

Sample group 1 showed slight changes (some signs of oxidation) in quality at 14 days, and clear changes (clear signs of oxidation) at 69 days. Samples from groups 2 and 3 did not show changes in quality (signs of oxidation) throughout the testing period.

TABLE 2

| | Group 1 (no scavenger, conventional container) | Group 2 (20 $cm^3$ $O_2$ scavenger, barrier container) | Group 3 (50 $cm^3$ $O_2$ scavenger, barrier container) |
|---|---|---|---|
| Day 0 | 0 | 0 | 0 |
| Day 6 | 0 | 0 | 0 |
| Day 14 | + | 0 | 0 |
| Day 27 | + | 0 | 0 |
| Day 69 | +++ | 0 | 0 |

What is claimed is:

1. A packaged food product comprising:

a container comprising a bottom, a top edge defining a top opening, and a wall extending between the bottom and the top edge and comprising an inside surface and an outside surface, wherein the bottom, top edge, and wall define an inside volume;

a holding element extending radially inwardly from the inside surface of the wall;

a retainer disc between the bottom and the holding element;

a sealing member removably attached to the top edge and sealing the top opening;

a scavenger element positioned between the bottom and the retainer disc, the scavenger element constructed to absorb substantially all moisture and oxygen from the air in the inside volume and selected from the group consisting of elemental iron, iron powder, autoclaved clay, sodium chloride, calcium, ascorbic acid, zeolite, oxazolidine, aluminosilicate, polymer, and mixtures thereof, wherein the wall and the bottom comprise a plurality of layers including at least one barrier layer such that the barrier layer has an oxygen transmission rate of 10 $cm^3/m^2$/day or less and a water vapor transmission rate of 10 $g/m^2$/day or less; and a dried meat product located in the inside volume.

2. The packaged food product of claim 1, wherein one layer of the wall and bottom is molded plastic.

3. The packaged food product of claim 1, wherein the holding element is positioned circumferentially along the inside surface and configured to hold the retainer disc in place thereby forming a scavenger compartment in the container below the retainer disc.

4. The packaged food product of claim 1 further comprising a lid removably coupled with the container and covering at least a majority of the sealing member.

5. The packaged food product of claim 4, wherein the lid is constructed of molded plastic.

6. The packaged food product of claim 5, wherein the lid further comprises a barrier layer.

7. The packaged food product of claim 1, wherein the sealing member is a foil seal.

8. The packaged food product of claim 1, wherein the container comprises an inert gas housed in the inside volume.

9. The packaged food product of claim 4, wherein the lid has an oxygen transmission rate of 10 $cm^3/m^2$/day or less.

10. The packaged food product of claim 4, wherein the lid has a water vapor transmission rate of 10 $g/m^2$/day or less.

11. The packaged food product of claim 1, wherein the barrier layer has an oxygen transmission rate of 1 $cm^3/m^2$/day or less and a water vapor transmission rate of 1 $g/m^2$/day or less.

12. The packaged food product of claim 1, wherein the barrier layer is an in-mold label.

13. The packaged food product of claim 1, wherein the barrier layer comprises of a coextruded cast or blown film material selected from the group consisting of: polypropylene, orientated polypropylene, ethylene vinyl alcohol, nylon, polyamide, orientated polyamide, polyethylene, polyethylene terephthalate, and combinations thereof.

14. The packaged food product of claim 1, wherein the container improves the shelf life of the dried meat product by at least 75 days.

15. The packaged food product of claim 1, wherein the container improves the shelf life of the dried meat product by at least 40 days.

16. The packaged food product of claim 1, wherein the container improves the shelf life of the dried meat product by at least 120 days.

17. The packaged food product of claim 1, wherein the container improves the shelf life of the dried meat product by at least 14 days.

18. The packaged food product of claim 1, wherein the holding element is a continuous lip inwardly extending from the inside surface of the wall.

19. The packaged food product of claim 1, wherein the holding element is a plurality of discontinuous extensions inwardly extending from the inside surface of the wall.

* * * * *